US010329814B1

(12) United States Patent
Tamer

(10) Patent No.: US 10,329,814 B1
(45) Date of Patent: Jun. 25, 2019

(54) DOOR HINGES

(71) Applicant: Albert Tamer, San Francisco, CA (US)

(72) Inventor: Albert Tamer, San Francisco, CA (US)

( * ) Notice: Subject to any disclaimer, the term of this patent is extended or adjusted under 35 U.S.C. 154(b) by 0 days.

(21) Appl. No.: 15/846,941

(22) Filed: Dec. 19, 2017

(51) Int. Cl.
*E05D 11/06* (2006.01)
*E05D 11/10* (2006.01)
*E05D 5/14* (2006.01)
*E05D 3/02* (2006.01)

(52) U.S. Cl.
CPC ..... *E05D 11/1007* (2013.01); *E05D 3/02* (2013.01); *E05D 5/14* (2013.01); *E05D 11/06* (2013.01); *E05D 11/105* (2013.01)

(58) Field of Classification Search
CPC ..... E05D 11/06; E05D 11/10; E05D 11/1007; E05D 11/1028; E05F 5/02; E05F 5/06; E05C 17/00; E05C 17/025; Y10T 16/551; Y10T 16/5513; Y10T 16/5515
See application file for complete search history.

(56) References Cited

U.S. PATENT DOCUMENTS 975,097 A * 11/1910 Wright ..... E05D 11/1078 16/330
1,440,713 A * 1/1923 Ausbourne ..... E05D 5/10 16/324
6,497,005 B2 * 12/2002 Apostoloff ..... E05C 17/025 16/375
7,197,791 B1 * 4/2007 Smith ..... E05D 11/06 16/334
8,327,505 B2 * 12/2012 Smith ..... E05D 3/02 16/374
8,739,366 B2 * 6/2014 Heninger ..... E05D 5/10 16/374
9,416,572 B2 * 8/2016 Tolliver ..... E05D 5/10
2009/0031531 A1 * 2/2009 Chang ..... G06F 1/1616 16/333
2010/0251520 A1 * 10/2010 Corso ..... E05D 5/12 16/342
2012/0117760 A1 * 5/2012 Corso ..... E05D 5/12 16/374
2012/0124776 A1 * 5/2012 McDonnell ..... E05D 11/06 16/375
2013/0104345 A1 * 5/2013 Granberry ..... E05D 11/06 16/374
2014/0173852 A1 * 6/2014 Heninger ..... E05D 5/14 16/375
2014/0259532 A1 * 9/2014 Millard ..... E05D 11/1028 16/326

* cited by examiner

*Primary Examiner* — Chuck Y Mah

(57) ABSTRACT

Door hinges are disclosed that are configured to allow operators to hold a door in an open position at specific and desired angles (and for such specific and desired angles to be easily and quickly modulated by an operator). In addition, the door hinges are configured to allow an operator to easily and quickly establish a maximum angle by which the hinge—and its attached door—are allowed to be opened, i.e., how wide the hinge and door are allowed to open (which also may be easily and quickly modulated by an operator).

12 Claims, 5 Drawing Sheets

DOOR HINGES

FIELD OF THE INVENTION

The field of the present invention relates to door hinges. More particularly, the field of the present invention relates to door hinges that allow operators (a) to hold a door in an open position at specific and desired angles (with such angles being adjustable by an operator) and (b) to establish a maximum angle by which the door/hinge can be opened, i.e., how wide the door/hinge is allowed to swing open (which may also be adjusted by an operator as desired).

BACKGROUND OF THE INVENTION

A door hinge typically consists of two "leaves" that are connected together by a cylindrical pin. The leaves have a flat and primarily rectangular surface, along with one or more cylindrical elements located along one edge of the leaf (which are commonly known as "knuckles"). The one or more knuckles on a first leaf typically align between (or adjacent to) the one or more knuckles on the other/second leaf. As such, a first leaf may be installed on the edge of a door, while the other/second leaf may be installed on the jamb of a door frame (or cabinet) in such a way that the cylindrical pin may be inserted through a set of aligned apertures located in all the knuckles of both leaves. The pin serves as the axis of rotation around which the hinge (and the attached door) swings open and shut.

During operation of a door, as it swings open and shut, it is often desirable to control how wide a door is allowed to swing open, to avoid hitting and damaging walls or objects behind the door. To resolve such problems, a variety of devices have been developed and commercialized in the past. However, such currently-available devices are often unsightly and are not always within reach or easily adjusted by an operator. For example, door stops of various designs have been developed; however, such currently-available door stops often require carpenters for installation and/or consist of unsightly bumpers that are incorporated into the hinge pin. In addition, such bumpers are often prone to damage caused by fast or forcefully opened swinging doors. Indeed, such bumpers have been known to damage a door frame when such bumpers make contact with the frame when a door is inadvertently and forcefully swung all the way open.

It also occasionally desirable to have a door remain in an open and fixed position for a duration of time. For example, retail businesses may expect frequent foot traffic, or it may be desirable to hold a door open to allow fresh air to enter a home or building (or to facilitate moving large objects into and out of the door of a room). Doors are often held open by placing a large obstacle against the door in its open position; or otherwise involve devices that have proven to be ineffective or difficult to operate.

In view of the foregoing, it would be desirable to provide improved door hinges that are configured (a) to establish a maximum angle by which the door/hinge can be opened (i.e., how wide the door/hinge is allowed to open) and (b) to hold a door in an open position at specific and desired angles. As the following will demonstrate, the inventions and improved door hinges described herein address such demands in the marketplace (as well as others).

SUMMARY OF THE INVENTION

According to certain aspects of the invention, door hinge assemblies are provided. The door hinge assemblies include a first leaf having a first knuckle and a second knuckle; a second leaf having a third knuckle and a fourth knuckle; and a pin. The invention provides that the first leaf and second leaf are configured to be combined and connected with each other, by aligning the first knuckle on top of the third knuckle, aligning the third knuckle on top of the second knuckle, and aligning the second knuckle on top of the fourth knuckle. The invention further provides that the pin is configured to be inserted into a contiguous channel that is formed when the first knuckle, second knuckle, third knuckle, and fourth knuckle are combined and aligned with each other as described above. Importantly, according to such aspects of the invention and as further described herein, the door hinge assembly is configured (a) to be held in an open position at specific and adjustable angles and (b) to have a maximum angle by which the door hinge can be opened, with that maximum angle also being subject to adjustment by an operator.

More particularly, the invention provides that the first knuckle of the first leaf includes a first set of teeth located on a bottom surface of the first knuckle that are oriented and configured to face a second set of teeth located on a top surface of the third knuckle of the second leaf. Upon adjoining the first set of teeth to the second set of teeth, a plurality of slots are formed between adjoined teeth of the first set of teeth and second set of teeth. The invention provides that the plurality of slots are configured to reversibly receive a peg, such that insertion of the peg into one of the slots prohibits rotation of the first knuckle and third knuckle about an axis formed by the pin, i.e., to lock the door hinge and attached door in an open position at a specific, and yet readily adjustable, angle. The invention further provides that the peg may be inserted into any of the plurality of slots to lock the door hinge, and the door attached thereto, at a desired angle of rotation about the axis formed by the pin. More particularly, the invention provides that the door hinge, and the door attached thereto, are configured to be locked at a desired angle of rotation about the axis formed by the pin in one-degree increments. In certain embodiments, the first leaf, second leaf, or both the first leaf and second leaf include a parking slot that is configured to securely and reversibly receive and hold the peg (e.g., when the peg is not being used).

According to further aspects of the invention, the door hinge assembly further includes a first ring that has one or more protruding anchors located on a bottom surface of the first ring (such as two aligned/protruding anchors). The protruding anchor is configured to be inserted into a channel (a runway) located on a top surface of the fourth knuckle of the second leaf. In addition, the first ring includes a third set of teeth located on a top surface thereof. The door hinge assembly further includes a second ring that has its own fourth set of teeth located on a bottom surface of the second ring that are configured to mate with the third set of teeth of the first ring. The second ring also includes a stop block located on a top surface of the second ring. Still further, the invention provides that the door hinge assembly includes a bumper located on a bottom surface of the second knuckle of the first leaf. In these embodiments, upon rotation of the bumper (as an integral part of the second knuckle) about the axis formed by the pin to an angle of rotation at which the bumper makes contact with the stop block of the second ring, the door hinge is prohibited from further rotating about such axis, i.e., it has reached the maximum angle by which the door hinge can be opened.

As further explained below, the invention provides that the maximum angle by which the door hinge can be opened may be easily and quickly adjusted by an operator. More particularly, the pin is configured to be reversibly withdrawn from the contiguous channel to allow the operator to adjust the maximum angle by which the door hinge can be opened. In such embodiments, the first ring and second ring are configured to be removed from the hinge assembly (after the pin has been withdrawn or partially withdrawn to a point that it is clear of the two rings); the first ring and second ring are configured to be separated from each other; the second ring and the stop block thereof are configured to be rotated about the first ring and the position of the stop block modified (as desired) relative to the location of the bumper of the second knuckle; the first ring and second ring are configured to then be re-connected to each other by mating the third set of teeth located on the top surface of the first ring with the fourth set of teeth located on the bottom surface of the second ring; and the connected first ring and second ring are configured to then be inserted back into the hinge assembly, and the pin re-inserted into the contiguous channel. In certain embodiments, the second ring may exhibit angle markings, to help an operator determine how wide he or she wishes to allow the door to open. Accordingly, the foregoing configuration allows an operator to easily and quickly adjust the maximum angle by which the door hinge can be opened.

The above-mentioned and additional features of the present invention are further illustrated in the Detailed Description contained herein.

DETAILED DESCRIPTION OF THE INVENTION

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

According to certain preferred embodiments of the present invention, improved door hinges are provided. More particularly, the present invention includes door hinges that are configured to allow operators to hold a door in an open position at specific and desired angles (and for the specific and desired angles to be easily and quickly modulated by an operator). In addition, the invention provides that the door hinges are configured to allow an operator to easily and quickly establish a maximum angle by which the door/hinge is allowed to be opened, i.e., how wide the door/hinge is allowed to open (which also may be easily and quickly modulated by an operator).

Figure 1:
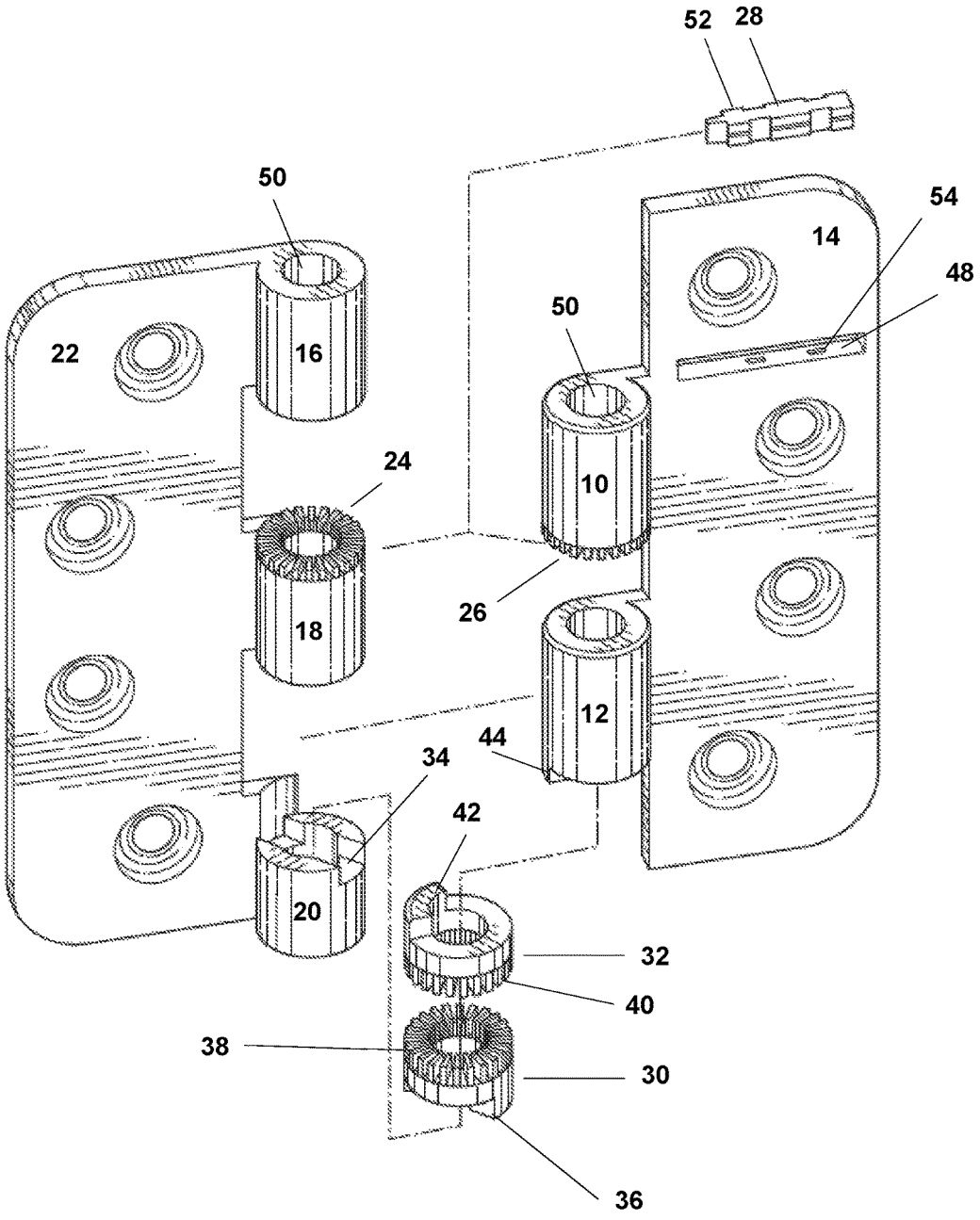
FIG. 1 is a disassembled view of the door hinges described herein.
Figure 2:
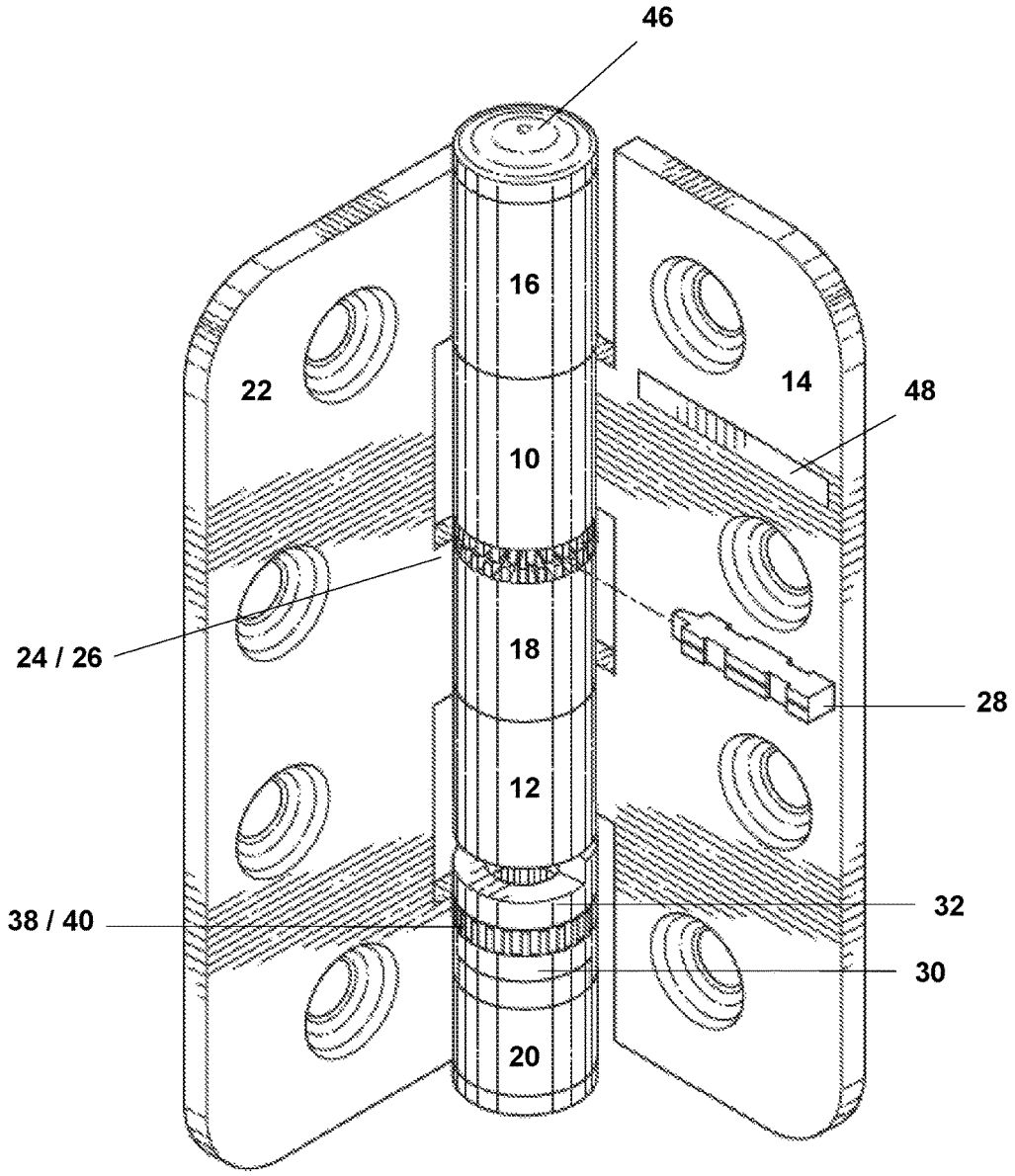
FIG. 2 is an assembled view of the door hinges described herein.
Figure 3:
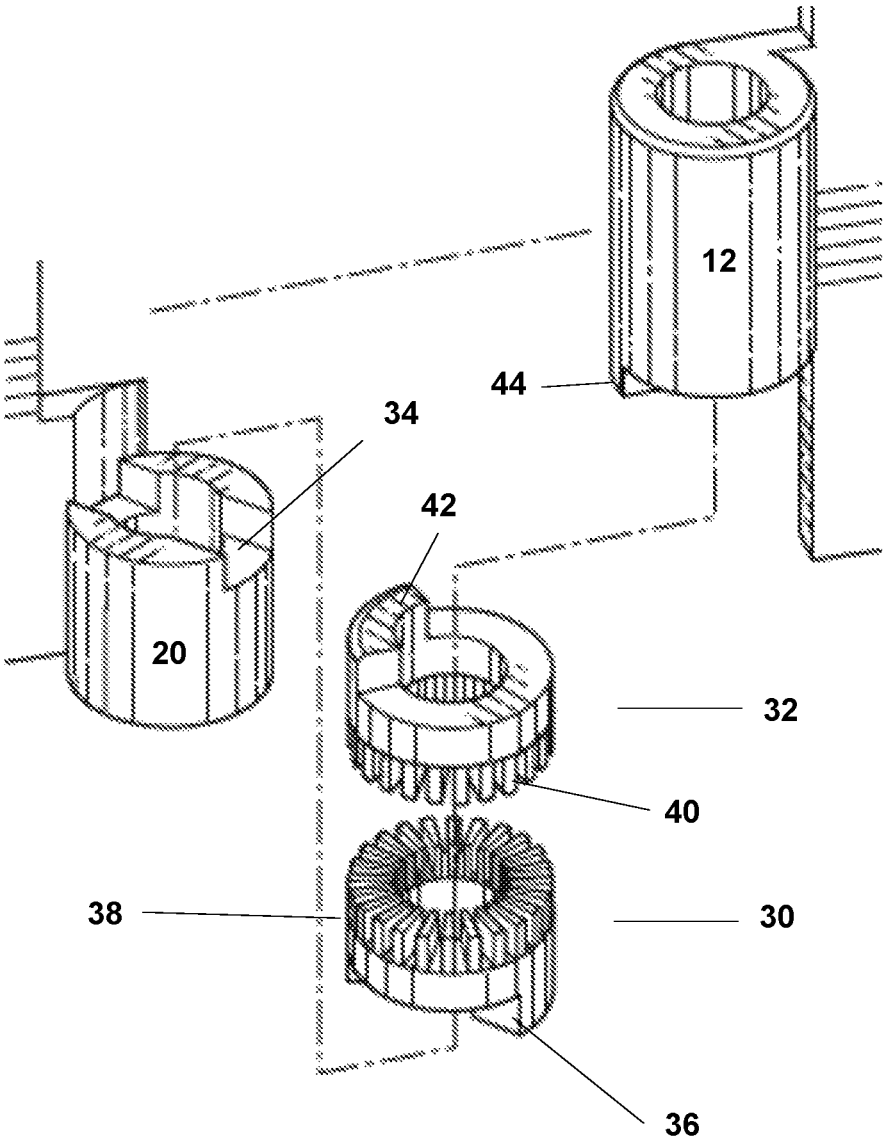
FIG. 3 is an enlarged view of a portion of the door hinges described herein, particularly showing the first and second rings of the lower (bottom) knuckles of such hinges.
Figure 4:
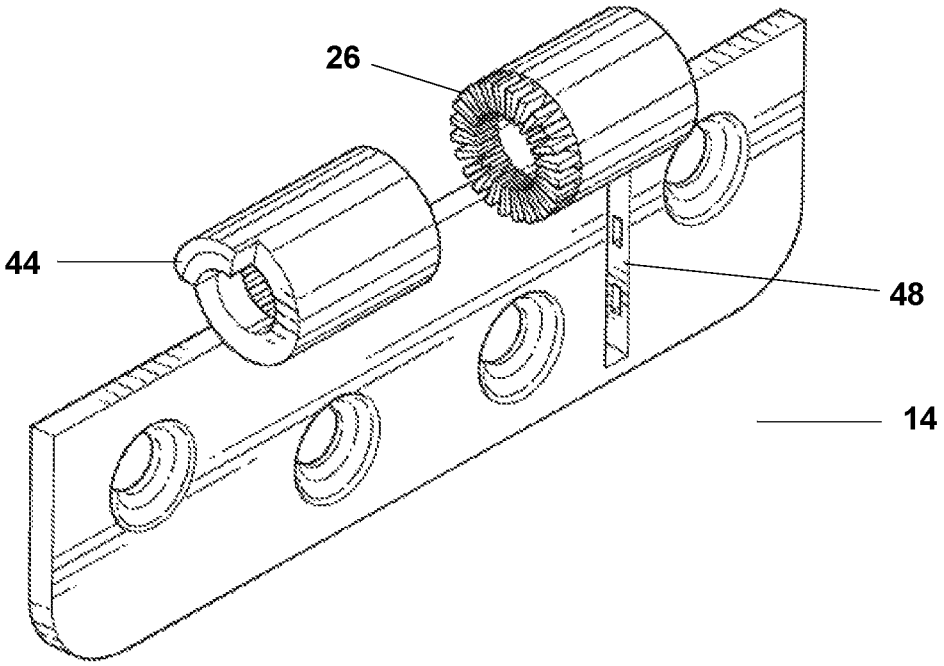
FIG. 4 is a perspective view of the first leaf described herein, particularly showing the bumper located on the second knuckle of such leaf.
Figure 5:
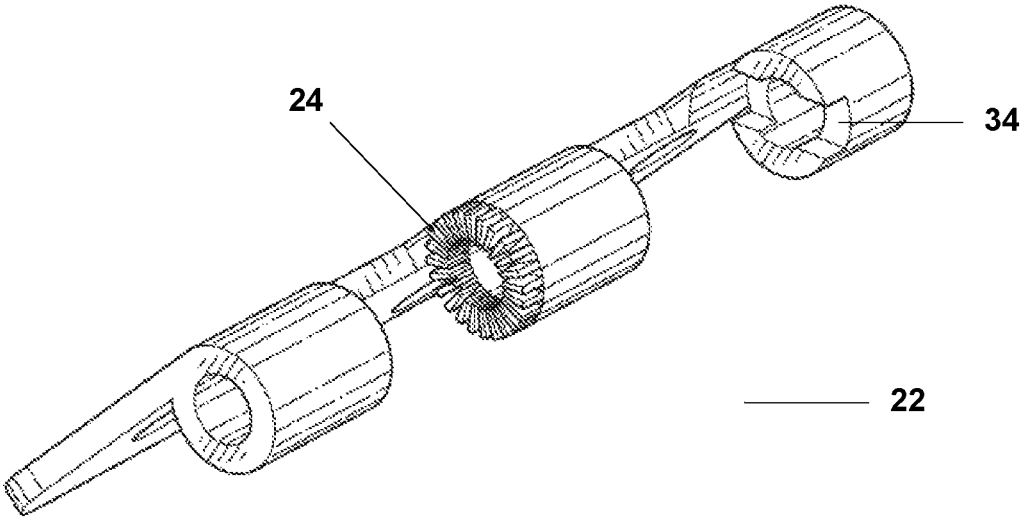
FIG. 5 is a perspective view of the second leaf described herein, particularly showing the runway located on the fourth knuckle of such leaf.
Figure 6:
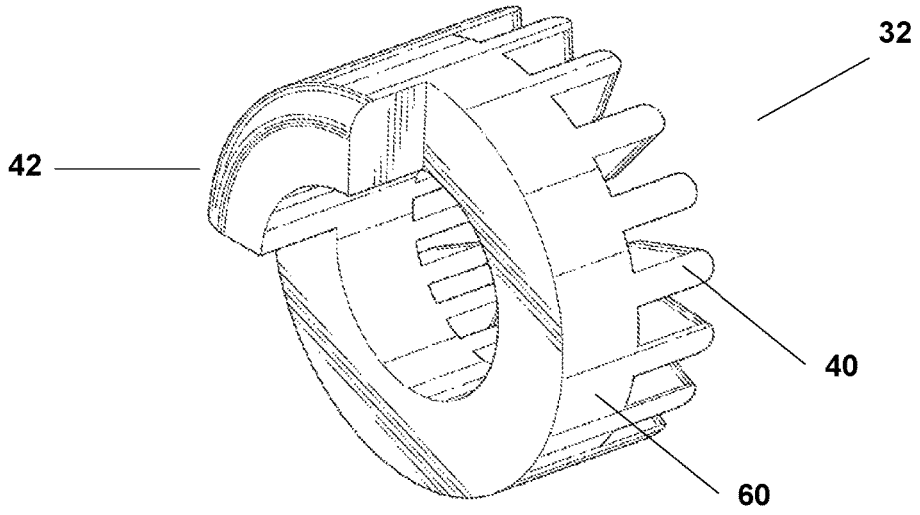
FIG. 6 is a perspective view of the second ring described herein.
Figure 7:
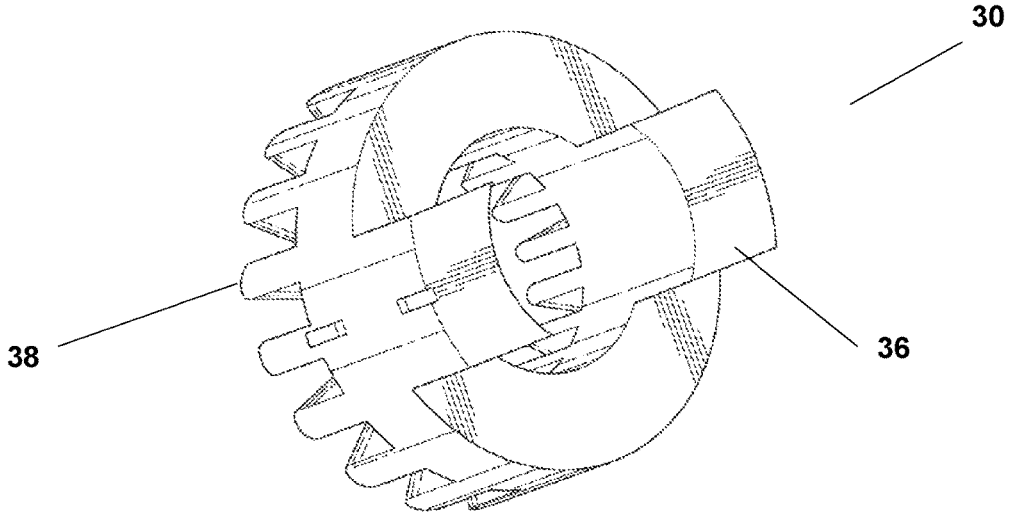
FIG. 7 is a perspective view of the first ring described herein.

Referring now to FIGS. 1-7, in certain preferred embodiments, the door hinges consist of a so-called "butt hinge" that includes two leaves 14/22. In certain embodiments, the invention provides that the hinges include at least two knuckles 10/12 on a first leaf 14 and at least two knuckles 18 and 20 on a second leaf 22 (but preferably at least three knuckles 16/18/20 on the second leaf 22). The two knuckles 10/12 on the first leaf 14 are oriented and configured to align between the, for example, three knuckles 16/18/20 on the second leaf 22 (FIGS. 1 and 2). The invention further provides that, in some embodiments, optional spacers may be positioned between, for example, knuckles 16 and 10 or knuckles 18 and 12. In these embodiments, one leaf is installed on the edge of a door (e.g., the first leaf 14), while the other leaf (e.g., the second leaf 22) is installed on the jamb of a door frame (or cabinet). Each of the knuckles 10, 12, 16, 18, 20 include an aperture 50 located in the center thereof. The apertures 50 are configured to create a contiguous channel (when such knuckles 10, 12, 16, 18, 20 are combined as shown in FIG. 2), with the resulting contiguous channel being configured to receive a cylindrical pin 46. In some instances, the contiguous channel is often referred to as a "hinge barrel" by those skilled in the art. The cylindrical pin 46 connects both leaves 14/22 together and, furthermore, serves as the axis of rotation around which the hinge and attached door swing open and shut. For the purpose of keeping the various knuckles described herein separate, the following will refer to knuckle 10 as the "first knuckle"; knuckle 12 as the "second knuckle"; knuckle 18 as the "third knuckle"; knuckle 20 as the "fourth knuckle"; and knuckle 16 as the "fifth knuckle."

In certain preferred embodiments, the invention provides that two knuckles, one connected to the first leaf 14 and the other connected to the second leaf 22, will include a set of matching teeth, such as the teeth 24/26 shown in FIGS. 1 and 2 (which are located around the perimeter of each knuckle, i.e., around the aperture 50). More particularly, for example, the third knuckle 18 will have a set of teeth 24 on the top surface of such knuckle 18 that are oriented and configured to face a set of teeth 26 located on the bottom surface of the first knuckle 10. When the teeth 24/26 are combined (FIG. 2), a plurality of slots are formed between each of the aligned and adjoined teeth 24/26. The invention provides that each of the plurality of slots are configured to receive a peg 28.

More particularly, when an operator desires to keep the door open by a certain amount, the door may be opened to the desired position, and the peg 28 may then be inserted into one of the slots located between the aligned and adjoined teeth 24/26. The invention provides that a tip of the peg 28 will exhibit dimensions and will be configured to securely (but reversibly) be inserted into the slots located between the aligned and adjoined teeth 24/26. When inserted into a slot, the invention provides that the peg 28 will prevent the hinge leaves 14/22 from rotating about the axis formed by the cylindrical pin 46 and, therefore, the door is not able to move or rotate open any further (until the peg 28 is manually withdrawn).

In certain embodiments, the invention provides that one of the leaves 14/22 will preferably include a parking slot 48 into which the peg 28 can be securely and reversibly placed and withdrawn, as needed. For example, and referring to FIG. 1, the peg 28 may include one or more protrusions 52 that include a slot in the middle portion thereof that is configured to nestably fit over a ridge 54 located in the parking slot 48. The invention provides that the parking slot 48 is preferably longer than the peg 28, to allow peg 28 to be inserted into the parking slot 48 and then allowed to slide back until the slots of the protrusions 52 engage around the ridges 54, thereby securing the peg 28 into its parking slot. To withdraw the peg 28 from its parking slot 48, an operator may slide the peg 28 forward until its front end makes contact with the end of the parking slot 48, thus moving the slots of the protrusions 52 away from ridges 54, such that the peg 28 can be pulled away from and out of its parking slot 48. The invention provides that the door hinge assemblies may employ other means for securely and reversibly connecting the peg 28 to a leaf, such as through the use of hooks, magnets, etc.

Still further, according to certain preferred embodiments, the invention provides that the two sets of teeth 24/26 are oriented in such a manner that the teeth 24 of the third knuckle 18 (i.e., the bottom teeth 24) are oriented in a repeated one-degree angular pattern—and, similarly, the matching teeth 26 (i.e., upper teeth 26) of the first knuckle 10 exhibit an increasing one-degree angular pattern. The invention provides that such configuration allows an operator to adjust the extent to which a door may be held in an open position by single-degree increments. In other words, such configuration allows an operator to swing the door open to any angle, in one-degree increments, and a tooth 26 of the first knuckle 10 will be positioned in a way that matches a corresponding tooth 24 of the third knuckle 18 below it (which creates a slot into which the peg 28 may be inserted). The invention provides that the upper teeth 26 of the first knuckle 10 will be configured to always meet and adjoin the bottom teeth 24 of the third knuckle 18, at the same angle modular number. In other words, the invention provides that a first upper tooth 26 will always meet a first tooth 24 below it at 0, 10, 20, 30, etc. degrees, and the same upper tooth 26 will always meet a second bottom tooth 24 at 1, 11, 21, 31, etc. degrees, and the same upper tooth 26 may be rotated to meet a third bottom tooth 24 at 2, 12, 22, 32, etc. degrees, and so forth.

As mentioned above, in certain preferred embodiments, the hinges of the present invention are further configured to establish a maximum angle by which the door/hinge can be opened (i.e., how wide the door/hinge is allowed to open). More particularly, the invention provides that the hinges include a set of two rings 30/32 that, together, are configured to enable an operator to select (and easily adjust) the extent to which the operator wants to allow the door to swing open (such that the door cannot be opened beyond that selected point). In such embodiments, the bottom knuckles 20/12 on each leaf 22/14 are modified to interact with the set of two rings 30/32. As used herein, "bottom knuckles" refer to the knuckles of the leaves that are closest to the bottom of the door; whereas, "top knuckles" refer to the knuckles of the leaves that are closest to the top of the door. When a leaf only has two knuckles, such as leaf 14 and knuckles 10/12, the top and bottom knuckles may also be referred to as the "middle knuckles," since those knuckles 10/12 are positioned between the outermost knuckles 16/20 when the door hinge is fully assembled, as shown in FIG. 2.

More particularly, a bottom (fourth) knuckle 20 of the second leaf 22 will include a runway 34. The runway 34 essentially consists of a channel—located on the top surface of the fourth knuckle 20—that is configured to fittingly receive a bottom of the first ring 30. Still more particularly, the invention provides that the bottom of the first ring 30 fits into the bottom knuckle 20 by sliding a landing (protruding) anchor 36 (or set of aligned anchors 36) of the first ring 30 into the runway 34 of the bottom (fourth) knuckle 20. The landing anchor 36 (or set of aligned anchors 36) of the first ring 30 essentially consists of a protrusion (or set of protrusions) that is configured to slide into (or mate with) the runway 34 of the bottom (fourth) knuckle 20. Still further, the invention provides that the top of the first ring 30 will preferably include a set of teeth 38 that are oriented and configured to mate with slots located between a set of corresponding teeth 40 located on the bottom of the second ring 32 (as illustrated herein, such teeth 38/40 are located around the perimeter of each ring 30/32, i.e., around the aperture 50 thereof). The invention further provides that the top of the second ring 32 includes a stop block 42, which essentially consists of a protrusion that extends beyond the surface of the other areas of the top of the second ring 32.

In such embodiments, the invention provides that the stop block 42 is configured to make contact and interfere with the rotating path of a bumper 44 that is located at the bottom of the next knuckle 12 located up the hinge (on the other leaf 14), i.e., the second knuckle 12. The invention provides that the bumper 44 essentially consists of a protrusion that extends beyond the bottom surface of the other areas of the bottom of the second knuckle 12 located up the hinge. As the door swings open (and the second knuckle 12 rotates), the bumper 44 rotates and, once the door reaches the end of the allowed path, the bumper 44 makes contact with the stop block 42 on the upper/second ring 32. The invention provides that the upper/second ring 32 is fixed in place to the first ring 30 below it by the interlocking teeth 38/40. As described above, the first ring 30 is, in turn, affixed to the bottom (fourth) knuckle 20 of the other leaf 22 vis-a-vis the runway 34 located in the top of such bottom fourth knuckle 20. In such embodiments, the door is not physically permitted to swing any wider, once the bumper 44 makes contact with the stop block 42—which allows an operator to control of how far the door is allowed to swing open.

According to certain preferred embodiments, the invention provides that angular graduations are also incorporated into the set of two rings 30/32. Such angular graduations enable an operator to select and manually set the second ring 32 (and its connected/integrally formed stop block 42) into the first ring 30 in desired orientations to modulate the maximum angle at which the hinge is allowed to swing open—i.e., before the bumper 44 of the second knuckle 12 makes contact with the stop block 42 on the second ring 32. The invention provides that employing the two rings 30/32—along with the runway 34 of knuckle 20—allows an operator to pull out (withdraw) the pin 46 from the contiguous channel formed by the knuckles 10, 12, 16, 18, 20, at least to an extent to clear (withdraw the pin 46 from) the two rings 30/32. Once the pin 46 has been (fully or partially) withdrawn to that extent, the invention provides that the two rings 30/32 may be manually removed (slid out) together along the runway 34, so that the rings 30/32 can be separated and reassembled (re-oriented) as desired, without having to remove a leaf 14/22 from the door or the frame (which is typically attached to the door or frame via one or more screws). The invention provides that the ability to quickly and easily adjust and re-orient the two rings 30/32 in this manner (and, therefore, the distance between the stop block 42 and bumper 44 along their respective paths of rotation, and the corresponding maximum angle by which the hinge/door is allowed to swing open), is very helpful both during initial installation (when deciding how far a door should be allowed to swing open) and subsequent thereto if an operator wishes to make changes to such parameters). In certain embodiments, the second ring 32 may exhibit angle markings along its outer perimeter 60 (FIG. 6), to help an operator determine how wide he or she wishes to allow the door to open.

Depending on the size of a door, a minimum of two hinges will typically be installed to secure a swinging door to a frame; however, it is relatively common to install three (or more) hinges per door. The invention provides that only one of such hinges would need to consist of the hinge of the present invention to achieve the desired functionality, while the remaining hinges may consist of conventional hinges. Still further, the invention provides that one feature described herein (e.g., knuckles 10 and 18, and the ability to hold a door open in a defined position) may be embodied in a first hinge, while a second feature (e.g., knuckle 12, knuckle 20, first ring 30, and second ring 32, and the ability to define the extent to which a door is allowed to open) may embodied in a second hinge. In addition, although the present specification (and Figures) portray a set of leaves with five knuckles total, the invention provides that fewer (or more) knuckles may be present in a hinge, so long as a sufficient number of knuckles are present in each leaf to incorporate the elements of the invention described herein. The invention provides that the door hinges described herein may be comprised any suitably rigid material, such as steel, brass, other alloys, rigid plastics, etc.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A door hinge assembly that comprises:

(a) a first leaf having a first knuckle and a second knuckle;

(b) a second leaf having a third knuckle and a fourth knuckle; and (c) a pin, wherein:

(i) the first leaf and second leaf are configured to be combined by aligning the first knuckle on top of the third knuckle, aligning the third knuckle on top of the second knuckle, and aligning the second knuckle on top of the fourth knuckle; and (ii) the pin is configured to be inserted into a contiguous channel that is formed when the first knuckle, second knuckle, third knuckle, and fourth knuckle are combined and aligned with each other, wherein the door hinge assembly is configured (A) to be held in an open position at any of a plurality of specific and adjustable angles and, separately and simultaneously, (B) to have a maximum angle by which the door hinge can be opened, wherein said maximum angle may be adjusted by an operator and said maximum angle may optionally represent an angle that differs from the specific and adjustable angles of (c)(ii)(A) above, wherein (y) the first knuckle of the first leaf comprises a first set of teeth located on a bottom surface of the first knuckle that are oriented and configured to face a second set of teeth located on a top surface of the third knuckle of the second leaf; and (z) upon adjoining the first set of teeth to the second set of teeth a plurality of slots are formed between adjoined teeth of the first set of teeth and second set of teeth, wherein the plurality of slots are configured to reversibly receive a peg, whereupon insertion of said peg into one of the slots prohibits rotation of the first knuckle and third knuckle about an axis formed by the pin.

2. The door hinge assembly of claim 1, which further comprises:

(a) a first ring that includes (i) a protruding anchor located on a bottom surface of the first ring that is configured to be inserted into a channel located on a top surface of the fourth knuckle of the second leaf and (ii) a third set of teeth located on a top surface of the first ring;

(b) a second ring that includes (i) a fourth set of teeth located on a bottom surface of the second ring that are configured to mate with the third set of teeth of the first ring and (ii) a stop block located on a top surface of the second ring; and (c) a bumper located on a bottom surface of the second knuckle of the first leaf, wherein upon rotation of the bumper about the axis formed by the pin to an angle of rotation at which the bumper makes contact with the stop block of the second ring, the door hinge is prohibited from further rotating about said axis.

3. The door hinge assembly of claim 2, wherein the pin is configured to be reversibly withdrawn from the contiguous channel to allow the operator to adjust the maximum angle by which the door hinge can be opened, wherein upon withdrawal of the pin:

(a) the first ring and second ring are configured to be removed from the hinge assembly;

(b) the first ring and second ring are configured to be separated from each other;

(c) the second ring and the stop block thereof are configured to be rotated about the first ring and the position of the stop block modified relative to a location of the bumper of the second knuckle; and (d) the first ring and second ring are configured to then be connected to each other by mating the third set of teeth located on the top surface of the first ring with the fourth set of teeth located on the bottom surface of the second ring, such that the first ring and second ring are configured to then be inserted back into the hinge assembly, and the pin re-inserted into the contiguous channel.

4. The door hinge assembly of claim 3, wherein the peg may be inserted into any of the plurality of slots to lock the door hinge, and a door attached thereto, at a desired angle of rotation about the axis formed by the pin.

5. The door hinge assembly of claim 4, wherein the door hinge, and the door attached thereto, are configured to be locked at a desired angle of rotation about the axis formed by the pin in one-degree increments.

6. The door hinge assembly of claim 5, wherein the first leaf, second leaf, or both the first leaf and second leaf include a parking slot that is configured to securely and reversibly receive and hold the peg.

7. A door hinge assembly that comprises:

(a) a first leaf having a first knuckle and a second knuckle;

(b) a second leaf having a third knuckle and a fourth knuckle; and (c) a pin, wherein:

(i) the first leaf and second leaf are configured to be combined by aligning the first knuckle on top of the third knuckle, aligning the third knuckle on top of the second knuckle, and aligning the second knuckle on top of the fourth knuckle; and (ii) the pin is configured to be inserted into a contiguous channel that is formed when the first knuckle, second knuckle, third knuckle, and fourth knuckle are combined and aligned with each other, wherein the door hinge assembly is configured (A) to be held in an open position at specific and adjustable angles and (B) to have a maximum angle by which the door hinge can be opened, wherein said maximum angle may be adjusted by an operator, wherein:

(x) the first knuckle of the first leaf comprises a first set of teeth located on a bottom surface of the first knuckle that are oriented and configured to face a second set of teeth located on a top surface of the third knuckle of the second leaf; and (y) upon adjoining the first set of teeth to the second set of teeth a plurality of slots are formed between adjoined teeth of the first set of teeth and second set of teeth, wherein the plurality of slots are configured to reversibly receive a peg, whereupon insertion of said peg into one of the slots prohibits rotation of the first knuckle and third knuckle about an axis formed by the pin.

8. The door hinge assembly of claim 7, which further comprises:

(a) a first ring that includes (i) a protruding anchor located on a bottom surface of the first ring that is configured to be inserted into a channel located on a top surface of the fourth knuckle of the second leaf and (ii) a third set of teeth located on a top surface of the first ring;

(b) a second ring that includes (i) a fourth set of teeth located on a bottom surface of the second ring that are configured to mate with the third set of teeth of the first ring and (ii) a stop block located on a top surface of the second ring; and (c) a bumper located on a bottom surface of the second knuckle of the first leaf, wherein upon rotation of the bumper about the axis formed by the pin to an angle of rotation at which the bumper makes contact with the stop block of the second ring, the door hinge is prohibited from further rotating about said axis.

9. The door hinge assembly of claim 8, wherein the pin is configured to be reversibly withdrawn from the contiguous channel to allow the operator to adjust the maximum angle by which the door hinge can be opened, wherein upon withdrawal of the pin:

(a) the first ring and second ring are configured to be removed from the hinge assembly;

(b) the first ring and second ring are configured to be separated from each other;

(c) the second ring and the stop block thereof are configured to be rotated about the first ring and the position of the stop block modified relative to a location of the bumper of the second knuckle; and (d) the first ring and second ring are configured to then be connected to each other by mating the third set of teeth located on the top surface of the first ring with the fourth set of teeth located on the bottom surface of the second ring, such that the first ring and second ring are configured to then be inserted back into the hinge assembly, and the pin re-inserted into the contiguous channel.

10. The door hinge assembly of claim 9, wherein the peg may be inserted into any of the plurality of slots to lock the door hinge, and a door attached thereto, at a desired angle of rotation about the axis formed by the pin.

11. The door hinge assembly of claim 10, wherein the door hinge, and the door attached thereto, are configured to be locked at a desired angle of rotation about the axis formed by the pin in one-degree increments.

12. The door hinge assembly of claim 11, wherein the first leaf, second leaf, or both the first leaf and second leaf include a parking slot that is configured to securely and reversibly receive and hold the peg.

* * * * *